United States Patent [19]

Kuge et al.

[11] Patent Number: 4,910,559

[45] Date of Patent: Mar. 20, 1990

[54] ELASTIC ROTATABLE MEMBER AND FIXING DEVICE USING SAME

[75] Inventors: Tsukasa Kuge, Tokyo; Masahiro Goto, Kawasaki; Isamu Sakane, Ohtsu, all of Japan

[73] Assignee: Canon Kabushiki Kaisha, Tokyo, Japan

[21] Appl. No.: 391,381

[22] Filed: Aug. 9, 1989

Related U.S. Application Data

[63] Continuation of Ser. No. 877,849, Jun. 24, 1986, abandoned.

[30] Foreign Application Priority Data

Jun. 28, 1985 [JP] Japan ..... 60-140435

[51] Int. Cl.[4] ..... G03G 15/20

[52] U.S. Cl. ..... 355/285; 355/282; 355/290; 355/295; 29/121.1; 219/216; 219/469; 428/451

[58] Field of Search ..... 358/285, 282, 290, 295; 219/216, 469–471; 432/60, 228; 29/121.1, 121.8; 226/190, 193; 428/451, 219, 315.7, 315.9, 319.3

[56] References Cited

U.S. PATENT DOCUMENTS

| | | | |
|---|---|---|---|
| 2,940,125 | 6/1960 | Beucker | 29/121.1 X |
| 3,545,371 | 12/1970 | Reist et al. | 271/272 X |
| 3,884,623 | 5/1975 | Slack | 432/60 |
| 4,089,378 | 5/1978 | Suzuki | 271/272 |
| 4,149,797 | 4/1979 | Imperial | 355/3 FU |
| 4,200,389 | 4/1980 | Matsui et al. | 29/121.8 X |
| 4,309,591 | 1/1982 | Kanoto et al. | 219/216 |
| 4,356,764 | 11/1982 | Haugen | 29/121.8 |
| 4,522,866 | 6/1985 | Nishikawa et al. | 29/132 X |
| 4,525,058 | 6/1985 | Hirabayashi et al. | 355/3 FU |
| 4,594,068 | 6/1986 | Bardutzky | 219/216 |
| 4,842,944 | 6/1989 | Kuge et al. | 428/451 |

FOREIGN PATENT DOCUMENTS

| | | | |
|---|---|---|---|
| 680405 | 2/1964 | Canada | 271/272 |
| 530584 | 12/1921 | France | 271/272 |
| 57-72538 | 5/1982 | Japan | 271/272 |
| 57-105763 | 7/1982 | Japan | 355/3 FU |
| 60-83060 | 5/1985 | Japan | 355/3 FU |
| 61-277554 | 12/1986 | Japan | 271/272 |

*Primary Examiner*—A. C. Prescott

*Attorney, Agent, or Firm*—Fitzpatrick, Cella, Harper & Scinto

[57] ABSTRACT

An elastic rotatable member for conveying a member to be conveyed includes an elastic layer, a resin layer formed on the elastic layer, wherein the resin layer has a portion wherein it has a thickness larger than the other portion to project outwardly. Also, an image fixing apparatus includes an elastic rotatable member including an elastic layer and a resin layer formed on the elastic layer, the resin layer having a portion projected outwardly, and a rotatable member cooperative with the elastic rotatable member to grip and convey a material carrying toner image to be fixed.

57 Claims, 3 Drawing Sheets

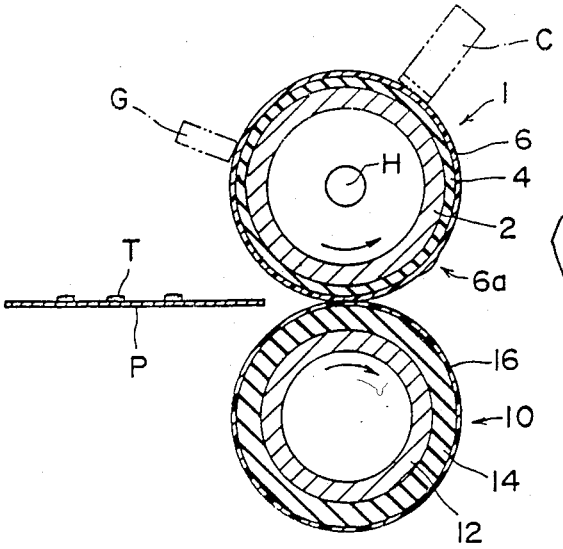
FIG. 1
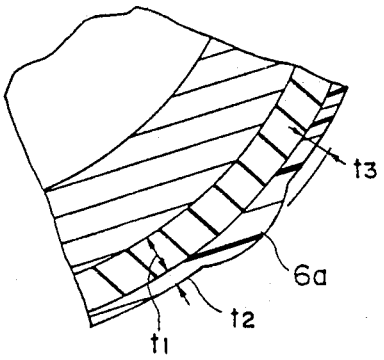
FIG. 2
FIG. 3
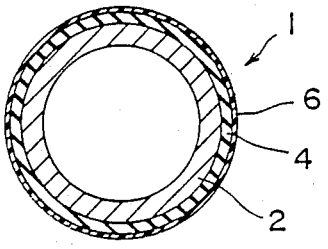
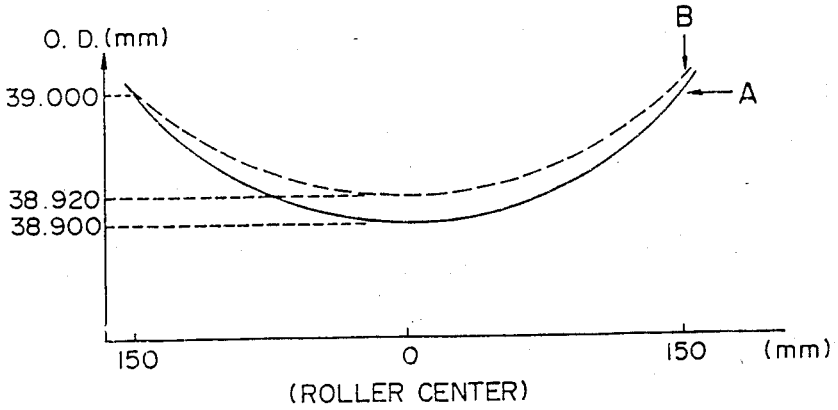
FIG. 4

ELASTIC ROTATABLE MEMBER AND FIXING DEVICE USING SAME

This appliction is a continuation of application Ser. No. 877,849 filed June 24, 1986, now abandoned.

FIELD OF THE INVENTION AND RELATED ART

The present invention relates to an elastic rotatable member and an image fixing device using the same which is usable with an image forming apparatus, such as an electrophotographic copying machine, a printer and the other various image forming apparatus. The elastic rotatable member is particularly suitable as a roller or belt for conveying a recording material and for fixing a toner image on the recording material such as paper or a sheet of paper in the image forming apparatus. The present invention is, therefore, related to an image fixing device using the elastic rotatable member. In the following, description will be made mainly with respect to an image fixing roller, but the present invention is not limited to this.

In an image forming apparatus, such as an electrophotographic copying machine, a good sheet conveying property, releasability and durability are required for rollers to convey along a predetermined passage a recording material or a toner carrying sheet as the material to be conveyed. Particularly, the good conveying property, releasability, wear resistance and image fixing properties are required under more severe conditions in the case of an image fixing roller which must convey a transfer material along a predetermined passage, while applying heat to an unfixed toner image on the transfer material without offset of the fused toner.

In order to satisfy those, as shown in FIG. 3, a proposal has been made wherein a core metal 2 is enclosed by an elastic material 4, which in turn is coated with a resin layer 6, which is formed by heat-shrinking a resin tube, whereby an image fixing elastic member or an elastic roller is constructed.

Conventionally, the rotatable member has been deemed as preferably having as smooth a surface as possible, and the cross-section of the roller has been exactly circular.

This fixing roller provides good performance with respect to the releasability, the wear resistance and the image fixing property. However, it involves a problem with the conveying property. The surface of this roller is of a material having good slidability such as fluorine resin, with the result of lower frictional coefficient, and therefore, slipping occurs between the roller and the paper, thus lowering the conveying property. The slipping between the roller and the paper disturbs the fused toner image, thus degrading the quality of the image.

In addition, this roller is sometimes reversely crowned for the purpose of enhancing the conveying property and preventing the wrinkle occurrence in the paper. The reverse-crown configuration is effective to provide the peripheral speed difference between the central portion and the marginal portion with respect to the width of the paper, thus producing pulling forces in the direction perpendicular to conveyance of the paper, the forces being effective to prevent the wrinkle occurrence. However, if the peripheral speed difference is too large, the conveying speeds are different in the central portion than in the marginal portion, so that only the lateral end portions are pulled, which can lead to the occurrence of wrinkle extending in the direction perpendicular to the direction of the conveyance, or which can lead to the production of a reaction force in the opposite direction to cause a slipping between the roller surface and the paper, resulting in deviation of the image.

Therefore, it is required that the amount of the reverse-crown is determined within the range not producing the wrinkle in the case of the conveying roller, particularly the image fixing roller. However, the range satisfying those requirements is very small, and therefore, the fact is that various limitations are imposed on the ambient conditions and the material of the paper to solve those problems.

However, in the recent image forming apparatus such as a copying apparatus, a duplex copy and a superimposing copy are needed even to the extent of the duplex superimposing copy, with the result that the material of the sheet and the size thereof vary very widely, so that it is no longer realistic to limit the material of the paper and the ambient conditions.

SUMMARY OF THE INVENTION

Accordingly, it is a principal object of the present invention to provide an elastic rotatable member and an image fixing device using the same with which the conveying power is increased, and the durability and the wear resistance are good.

It is another object of the present invention to provide an elastic rotatable member and an image fixing device using the same having sufficient elasticity and releasability and further good conveying property, wherein the wear resistance is further improved.

It is a further object of the present invention to provide an elastic rotatable member and an image fixing device using the same by which the quality of the fixed image is improved, and wherein the conveying property, the releasability and the wear resistance are improved.

According to an embodiment of the present invention, the elastic rotatable member comprises an elastic layer and a resin layer formed on the surface of the elastic layer, wherein the resin layer has a projecting (or projected) portion wherein the thickness of the resin layer is thicker than the area around it. The elastic rotatable member may be in the form of a roller or roll or in the form of a belt. In a more preferable embodiment, the elastic rotatable member in the form of a roller is reversely crowned, wherein the tolerable range of the amount of the reverse-crown is widened, and the range of the usable material of the member to be conveyed is enlarged.

According to another embodiment of the present invention, an image fixing device is provided, which comprises an image fixing rotatable member provided with a heat source and a pressing roller for pressing the transfer material to the fixing rotatable member, wherein the elastic rotatable member comprises an elastic layer and a resin layer formed on the elastic layer, and wherein at least one of the elastic rotatable members has the resin layer having a projected portion having a thickness larger than that around the same.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a sectional view of an image fixing device using an elastic rotatable member according to an embodiment of the present invention.

FIG. 2 is an enlarged sectional view of a part of the elastic rotatable member shown in FIG. 1.

FIG. 3 is a cross-sectional view of a conventional elastic rotatable member.

FIG. 4 is a graph showing the amount of the reverse-crown of the elastic roller according to another embodiment of the present invention.

DESCRIPTION OF THE PREFERRED EMBODIMENTS

Figure 5:
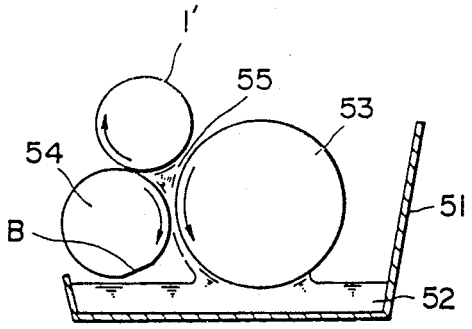
FIG. 5 is a sectional view of an apparatus for manufacturing the elastic rotatable member according to the present invention.

Referring now to FIGS. 1 and 2, there is shown a roller according to an embodiment of the present invention, which is used in an image fixing device wherein a toner image is heat-fixed in an electrophotographic copying apparatus as an example of the image forming apparatus.

The image fixing device, as shown in FIG. 1, includes a fixing roller 1 having a heat source H therewithin, which roller is contactable to an unfixed toner image T carried on a transfer paper or sheet P, and includes a pressing roller 10 for urging the transfer sheet P to the fixing roller 1. The fixing roller 1 and the pressing roller 10 have similar structures comprising core metals 2 and 12, elastic layers 4 and 14 and resin layers 6 and 16.

Preferably, the fixing device is provided with a temperature detecting and controlling means G for detecting the surface temperature of the image fixing roller 1 and controlling the surface temperature within the range of optimum toner fusing temperature, for example 160°–200° C., and with an offset preventing liquid applying means C for applying offset preventing liquid, such as silicon oil onto the surface of the fixing roller and also for cleaning the surface thereof.

The image fixing roller 1 includes a core metal of a good heat conductivity such as aluminum, the elastic layer 4 of a silicone rubber on the core metal 2 and the resin layer 6 formed on the elastic layer 4. In this embodiment, the elastic layer 4 has a layer thickness $t_1$ of 0.3–0.8 mm and has an impact resilience of 65–85%. The resin layer 6 is preferably made of PFA resin (tetrafluoroethylene perfluoroalcoxyethylene copolymer) or PTFE resin (tetrafluoroethylene) or another fluorine resin. In this embodiment, the layer thickness thereof $t_2$ is 10–25 microns, and the film strength is not less than 50 kg/cm$^2$.

In this embodiment, the layer thickness $t_2$ of the resin layer 6 of the fixing roller 1 is generally uniform over the circumference thereof, but it is thicker ($t_3$) at a portion 6a. The thickness $t_3$ is suitably determined by one ordinary skilled in the art, but it is preferably not more than 50 microns and more preferably not more than 30 microns so as to provide desired image fixing effect and conveying effect in the case of the image fixing roller. The projected portion 6a provided by the thicker portion is smoothly curved.

The pressing roller 10 has the structure similar to that of the fixing roller 1, but the core metal 12 is of a stainless steel or iron, and the silicone rubber elastic layer 14 is thicker, for example, 4–10 mm, and the impact resilience is 65–85% in this embodiment. The resin layer 16 is of PFA or PTFE resin similarly to the case of the image fixing roller 1, but the layer thickness $t_2$ is 5–35 microns, and the film strength is not less than 50 kg/cm$^2$ in this embodiment.

In this embodiment, the pressing roller 10 is not provided with the projected portion in the resin layer 16, but it is possible that a projected portion is formed on a part of the resin layer similarly to the case of the image fixing roller 1 by partly increasing the thickness of the resin layer 16. In this case, the thickness of the projected portion $t_3$ is preferably 7–55 microns. As another alternative, the projected portion is not formed on the fixing roller 1, but is formed only on the pressing roller 10.

The fixing roller 1 and the pressing roller 10 are symmetrical with respect to a center in the direction of its length. Preferably, the fixing roller 1 (or the pressing roller 10) is reversely crowned wherein the diameter is slightly smaller in the central portion than in the longitudinal end portions.

FIG. 4 shows an example of the amount of the reverse-crown in an elastic rotatable member as a reversely crowned fixing roller 1 according to an embodiment of the present invention, wherein $t_1$ is 0.5 mm, $t_2$ is 20 microns and $t_3$ is 40 microns. Both of the amounts of the crown in the layer thickness $t_2$ and the layer thickness $t_3$ are shown as the difference in the diameter of the roller between the center of the roller (minimum diameter) and a portion apart therefrom within the range of the effective length of the image fixing roller, that is, 150 mm from the center toward longitudinal opposite ends.

The above-mentioned figure of 40 microns ($=t_3$) is the maximum thickness at the center of the roller, and the thickness is gradually decreased to $t_2=20$ microns toward the ends of the roller.

The outer diameter of the image fixing roller is measured by a laser length meter available from Canon Kabushiki Kaisha, Japan. The amount of the crown in the layer thickness $t_2$ is as shown in FIG. 4 by solid line A, and the amount of crown in the layer thickness $t_3$ is as shown by broken line B. More particularly, the amount of the reverse-crown of the solid line A is 100 microns, while the amount of the broken line B is 80 microns.

Now, the description will be made with respect to method of manufacturing the fixing roller 1 described above with reference to FIG. 9. First, a metal core 2 is finished in a predetermined diameter. A vulcanized silicone rubber layer having the thermal conductivity of $1.4\times10^{-4}$–$1.5\times10^{-3}$ is formed into a silicone rubber roller having the desired configuration. Preferably, the silicone rubber roller is slightly reversely crowned, that is, the diameter is slightly smaller in the center than in the marginal portions.

The surface of the rubber roller is coated over the entire length thereof with unsintered fluorine resin, for example, a dispersion of the fluorine resin (fluorine resin powder dispersed in water with a surface-active agent).

In order to provide a projected portion by partly increasing the thickness of the fluorine resin layer, the method of coating is used, as shown in FIG. 5.

Figure 6:
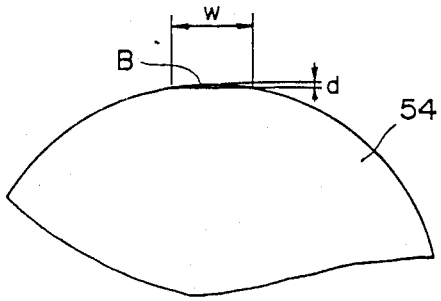
FIG. 6 is an enlarged view of a part of a squeezing roller used with the apparatus of FIG. 5.

The fluorine resin dispersion 52 is contained in a container 51. The dispersion 52 is drawn up by a coating roller 53, and a pool of the liquid 55 is formed with a squeezing roller 54 which rotates at a peripheral speed less than that of the coating roller 53 by 20–60%. The fluorine resin dispersion is transferred from the pool 55 to the fixing roller (rubber roller) 1' as a uniform thickness layer. Those rollers rotate in the direction indicated by arrows. The squeezing roller 54 has the complementary crowned surface which corresponds to the reverse crown of the fixing roller 1'. Further, a part of the circumference thereof is formed so that the amount of crown is small at the portion B. The speeds of the squeezing roller 54, the coating roller 53 and the fixing roller 1' are suitably selected by one skilled in the art. Between the squeezing roller 54 and the fixing roller 1', there is a gap of 25 microns at a position 150 mm away from the center in this embodiment. More particularly, in this embodiment a part B of the circumference is cut away as shown by a broken line in FIG. 6. The amount of the cut-away is small at the center of the roller 54 and is larger toward the opposite ends.

Figure 7:
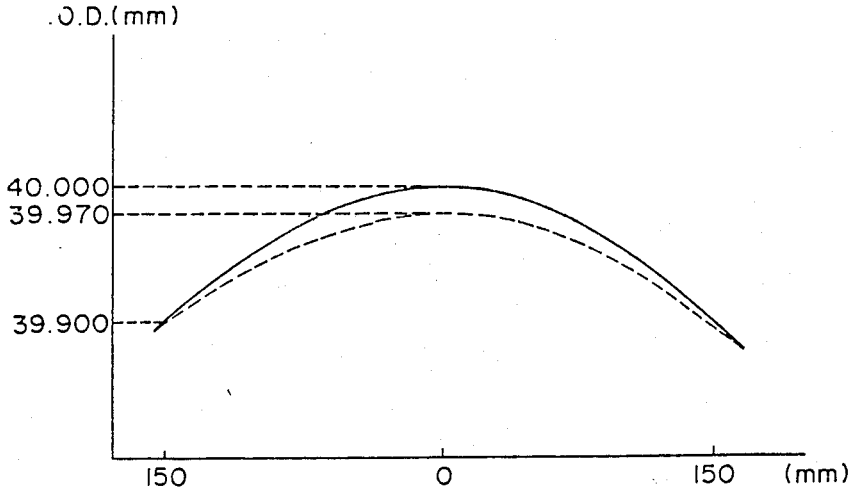
FIG. 7 is a graph showing the amount of crown of the roller of FIG. 6.

FIG. 7 shows an amount of crown in an example of the squeezing roller 54. In this example, the outer diameter of the roller 54 is 40.00 mm at the center, and the cut-away portion B has a width w of 5 mm and depth d of 0.03 mm at the center and has a width w of 0.5 mm or smaller and a depth d of 0.01 mm or smaller at the end portions. In FIG. 7, the part of the circumference B cut away is indicated by a broken line, and the rest is indicated by a solid line.

The fluorine resin dispersion which is coated in the manner that is is partly thicker, is heated at a temperature of 327° C. or higher which is the glass transition of the crystalline melting point and becomes a resin coating in the form of film. More particularly, the silicone rubber roller coated with the unsintered fluorine resin is heated at a temperature higher than the crystalline melting point (327° C. or higher in PTFE, and 306° C. or higher in PFA).

The silicone rubber itself shows good rubber properties in the impact resilience, compression permanent strain or the like. However, if it is heated beyond 300° C., it smokes or depolymerizes, more when it is heated beyond 306° C. or 327° C. This prevents formation of good fluorine resin layer, and in addition, it deprives the rubber of the rubber property.

Therefore, it is preferable that the applied fluorine resin is heated beyond the crystalline melting point to sinter while maintaining the silicone rubber layer at a lower temperature not resulting in the smoking or depolymerization (lower than 300° C. at maximum). One of the method of doing this is to quickly cool the rubber layer from the inside of the core metal, while quickly heating the unsintered fluorine resin. Another example is the dielectric heating method utilizing the fact of the dielectric loss tangent of the liquid fluid resin (dispersion) being larger than that of the rubber layer.

By those methods, a thermal gradient is produced in the direction of the thickness of the silicone rubber, and it is heated up to 200°–280° C., while the unsintered fluorine resin is heated beyond the crystalline melting point (more particularly 340°–380° C. of the sintering temperature in the case of PTFE) for 5–10 minutes.

After the sintering, the roller is quickly cooled. By this cooling, a sintered fluorine resin layer is formed which has a crystallinity index of not more than 95%, a tensile strength not less than 50 kg/cm$^2$ and a contact angle not less than 100 degrees with respect to water. The sintered layer is strongly cross-contacted to the rubber roller with sufficient thickness.

Thus, the fixing roller (heating roller) exhibits the desired rubber properties by the backing silicone rubber as before the formation of the resin layer, and also exhibits the resin properties by the surface fluorine resin layer completely sintered, and in addition, the bond between those layers are strong.

According to the structure of the roller which has been formed in accordance with the present invention so that the film thickness of the resin layer is partly large, good image fixing properties, good conveying properties, good releasability and high wear resistance are provided in either of the image fixing roller (pressing roller) with the reverse-crown or without it. In further detail, without the reverse-crown, the projected resin layer provided according to the present invention is effective to increase the pressure with which the member or material to be conveyed is gripped, so that the conveying power is increased. Particularly when the roller is reversely crowned, the amount of the reverse-crown is partly small according to the present invention, so that the pulling force applied to the marginal portions of the member is reduced adjacent that portion. Therefore, the restoring force produced in the member is released before it is stored up to such an extent that the restoring force results in the occurrence of slipping. By this, the image deviation or the occurrence of wrinkle in the direction perpendicular to the conveyance of the member is not easily produced. Further, this advantage is enhanced because the small reverse-crown portion is constituted by increasing the thickness of the resin layer. The reason for this is considered to be that the surface of the thicker resin layer portion is more or less harder than the other portion with the result of lower followability, so that only a very small amount of slip not resulting in image deviation is produced.

Since the small reverse-crown portion is small, the behavior with respect to the wrinkle in the direction of the sheet conveyance is equivalent to the conventional case.

As a result, according to the present invention, the deviation of the image and the wrinkle in the direction perpendicular to the sheet conveyance are reduced as compared with the conventional conveyance method, whereby the amount of the reverse crown can be increased without the wrinkle in the direction of the sheet conveyance.

Figure 8:
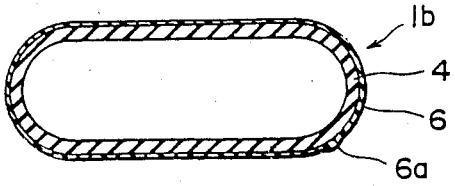
FIG. 8 is a sectional view of an elastic rotatable member according to a further embodiment of the present invention.

The foregoing description has been made with respect to the fixing roller (pressing roller) usable with an image fixing device. However, the present invention is applicable to the case of an elastic belt **1*b* as shown in FIG. 8, wherein no core metal is used, and an endless belt-like elastic layer 4 is formed, and a resin layer 6 is formed thereon. Of course, there is formed a projected portion 6*a* in the resin layer 6**.

Further, the present invention is applicable in addition to the image fixing rollers to a conveying elastic member for conveying a transfer sheet and other member or material to be conveyed. That is, a conveying elastic roller or belt can be formed in accordance with the present invention. In those cases, the elastic layer may be made for fluorine rubber, EPDM or the like as well as of the silicone rubber. As for the resin layer, another resin such as silicone resin is usable.

When the elastic rotatable member according to the present invention is used for the simple conveyance and others, the thickness of the layers $t_2$ and $t_3$ are suitably determined by one skilled in the art.

According to the present invention, when the elastic rotatable member is used as a conveying roller or belt, it shows good conveying property; and when it is used as an image fixing roller or belt, the conveying property is good with improved image fixing property, durability and the wear resistance.

Additionally, the image fixing device according to the present invention provides better image fixing property with respect to the toner image, and in addition, the durability and the wear resistance and the conveying properties are improved.

Figure 10:
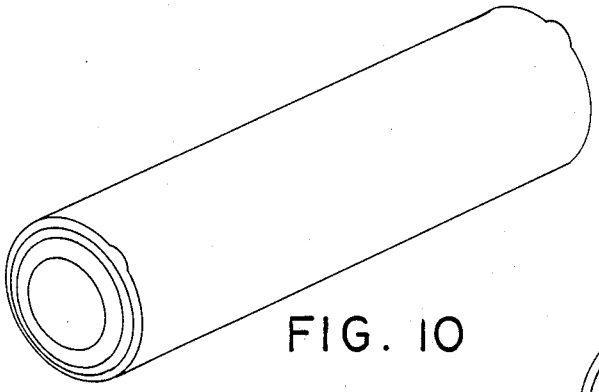
FIG. 10 is a perspective view of an elastic rotatable member having a single projection extending continuously along its length.
Figure 12:
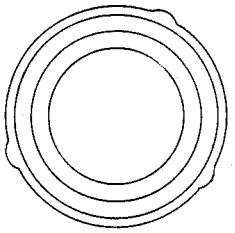
FIG. 12 is a side view of an elastic rotatable member having three projections.

As shown in FIG. 12, plural projected portions may be formed instead of single projected portion. However, in view of the danger of poor image fixing, not more than three portions are preferably provided. Most preferable is that a single continuous projected portion is provided as shown in FIG. 10. The projected portion may extend in a direction crossing with the direction of conveyance. However, the most preferable is that there is a distribution in the direction of length thereof and projected outwardly along the reverse-crown configuration. By this, the conveying power is increased, and in addition, a stabilized image fixing and conveyance can be maintained even when the variation of the amount of the reverse-crown is increased. When the projected portion is too large, the rotating torque suddenly increases too much, which can result in non-uniform image fixing action. Therefore, it is preferably projected by not more than 25 microns and not less than 2–3 microns. Here, the projection should be distinguished from projections of so-called surface roughness in that the projection of the present invention produces difference in the peripheral speed stemming from the radius of the outer surface is larger at the projected ridge. When the height of the projection is not more than 20 microns, the possible difference in the quality of the fixed image between the projected portion and the portion therearound, is not observed by naked eyes with good conveying property. Those conditions are particularly preferable in the case of the rotatable member for the image fixing device.

In the case of the reverse-crown, it is preferable that the radius of the projected surface at the longitudinal end portions is larger than that of the projected surface at the central portion. It is further preferable that the above is satisfied, and in addition, the radius of the non-projected portion surface at the longitudinal end portions is larger than that of the projected surface at the central portion, in view of the case where the two rollers are skewed.

Figure 11:
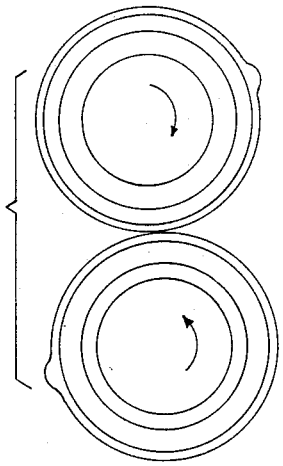
FIG. 11 is a side view of an image fixing device with projecting portions on each rotatable member.

With reference to FIG. 11, the projected portions are formed both on the rotatable members of the image fixing device, a phase difference is preferably provided so as not to press-contact those portions. By doing this, the projected portions actable on the sheet are distributed so that the sheet is contacted to the projected portion at least once, thus providing better conveying property. From this standpoint, the diameter of the roller or rollers can be decreased so as to decrease the length thereof usable for the conveyance, that is, the circumferential length of the roller.

While the invention has been described with reference to the structures disclosed herein, it is not confined to the details set forth and this application is intended to cover such modifications or changes as may come within the purposes of the improvements or the scope of the following claims.

What is claimed is:

1. An elastic rotatable member for fixing an image, comprising:

an elastic layer; and a fluorine or silicone resin surface layer formed on said elastic layer, said resin layer having a surface with an outwardly projecting portion which extends continuously along substantially the entire length of said rotatable member.

2. A member according to claim 1, wherein said elastic rotatable member is a heating roller having heating means inside said elastic layer.

3. A member according to claim 1, wherein said elastic layer is of silicone rubber, and wherein said resin layer is of fluorine resin.

4. A member according to claim 1, wherein said resin layer is formed by applying liquid resin on a vulcanized rubber layer which is said elastic layer and completely sintering it, wherein said resin layer has a film strength not less than 50 kg/cm$^2$.

5. A member according to claim 1, wherein said elastic layer is of a vulcanized rubber layer, and said resin layer is formed by sintering a liquid containing resin applied by applying roller means on said rubber layer, and wherein said resin layer has a releasability.

6. An image fixing apparatus, comprising:

an elastic rotatable member including an elastic layer and a resin surface layer formed on said elastic layer, said resin layer having an outwardly projecting portion which extends continuously along substantially the entire length of said rotatable member; and a second rotatable member in pressure contact with said elastic rotatable member to form a nip therebetween through which a material carrying a toner image may be passed to fix the toner image on the material.

7. An apparatus according to claim 6, wherein said elastic rotatable member contains heating means inside said elastic layer.

8. An apparatus according to claim 6, wherein said second rotatable member includes an elastic layer and a resin layer formed on said elastic layer and having an outwardly projecting portion which extends continuously along substantially the entire length of said second rotatable member.

9. An apparatus according to claim 8, wherein the projecting portions of said elastic rotatable member and said second rotatable member do not simultaneously pass through the nip.

10. An apparatus according to claim 6, wherein said elastic layer is of silicone rubber, and said resin layer is of fluorine resin, and wherein said resin layer is formed by applying liquid resin on a vulcanized rubber layer which is said elastic layer and completely sintering it, and wherein said resin layer has a film strength of not less than 50 kg/cm$^2$.

11. An apparatus according to claim 6, wherein said elastic layer is of a vulcanized rubber layer, and the resin layer is formed by sintering a liquid containing resin applied by applying roller means on said rubber layer, and wherein said resin layer has a releasability.

12. An apparatus according to claim 11, wherein said resin layer is produced by sintering and then quickly cooling said resin, has a tensile strength not less than 50 kg/cm$^2$, has a contact angle not less than 100 degrees with respect to water, and has a thickness of not less than 5 microns and not more than 35 microns except for the projected portion.

13. An elastic rotatable member for fixing a toner image, comprising:

an elastic layer; and a resin surface layer formed on said elastic layer, said resin layer having a surface with an outwardly projecting portion which extends continuously along substantially the entire length of said rotatable member, wherein the amount of projection of said projecting portion is not more than 40 microns.

14. A member according to claim 13, wherein said member is contactable to an image to be fixed and is provided with a heating source therein.

15. A member according to claim 14, wherein the amount of projection of said projecting portion is not more than 25 microns.

16. A member according to claim 15, wherein the amount of projection of said projecting portion is not more than 20 microns.

17. A member according to claim 13, wherein a plurality of such projecting portions are formed, and the number thereof is not more than three.

18. A member according to claim 13, wherein only one such projecting portion is formed.

19. In an image fixing apparatus, the improvement comprising:

an elastic rotatable member including an elastic layer and a resin surface layer formed on said elastic layer, said resin layer having an outwardly projecting portion which extends continuously along substantially the entire length of said rotatable member; and a second rotatable member in pressure contact with said elastic rotatable member to form a nip therebetween through which a material carrying a toner image may be passed to fix the toner image on the material.

20. An apparatus according to claim 19, wherein said elastic rotatable member contains heating means inside said elastic layer.

21. An apparatus according to claim 19, wherein the amount of projection of said projecting portion is not more than 25 microns.

22. An apparatus according to claim 21, wherein the amount of projection of said projecting portion in not more than 20 microns.

23. An apparatus according to claim 29, wherein said second rotatable member includes an elastic layer and a resin layer formed on said elastic layer and having an outwardly projecting portion which extends continuously along substantially the entire length of said second rotatable member.

24. An apparatus according to claim 23, wherein said projecting portions of said elastic rotatable member and said second rotatable member do not simultaneously pass through the nip.

25. An apparatus according to claim 23, wherein a surface of said cooperative rotatable member is of resin.

26. An apparatus according to claim 23, wherein the amount of projection of said projecting portion of said second rotatable member is not more than 40 microns.

27. An apparatus according to claim 26, wherein the amount of projection of said projecting portion of said second rotatable member is not more than 25 microns.

28. An apparatus according to claim 27, wherein the amount of projection of said projecting portion of said second rotatable member is not more than 20 microns.

29. An elastic rotatable member for fixing an image, comprising:

an elastic layer; and a resin surface layer formed on said elastic layer, said resin layer having a surface with an outwardly projecting portion, wherein said projecting portion extends continuously across said rotatable member in a direction substantially parallel to the rotational axis of said rotatable member.

30. A member according to claim 29, wherein said projected portion extends over substantially the entire width of said rotatable member.

31. A member according to claim 29, wherein said projected portion extends linearly.

32. A member according to claim 29, wherein the amount of projection of said projecting portion is not more than 40 microns.

33. A member according to claim 32, wherein the amount of projection of said projecting portion is not more than 25 microns.

34. A member according to claim 33, wherein the amount of projection of said projecting portion is not more than 20 microns.

35. A member according to claim 29, wherein a plurality of such projecting portions are formed, and the number thereof is not more than three.

36. A member according to claim 29, wherein only one such projecting portion is formed.

37. In an image fixing apparatus, the improvement comprising:

an elastic rotatable member including an elastic layer and a resin surface layer formed on said elastic layer, said resin layer having an outwardly projecting portion, wherein said projecting portion extends continuously across said rotatable member in a direction substantially parallel to the rotational axis of said rotatable member; and a second rotatable member in pressure contact with said elastic rotatable member to form a nip therebetween through which a material carrying a toner image may be passed to fix the toner image on the material.

38. An apparatus according to claim 37, wherein said elastic rotatable member contains heating means inside said elastic layer.

39. An apparatus according to claim 37, wherein said second rotatable member includes an elastic layer and a resin surface layer formed on said elastic layer and having an outwardly projecting portion.

40. An apparatus according to claim 39, wherein said projecting portions of said elastic rotatable member and said second member do not simultaneously pass through the nip formed between said elastic rotatable member and said second member.

41. An apparatus according to claim 40, wherein a surface of said cooperative rotatable member is of resin.

42. An apparatus according to claim 39, wherein the amount of projection of said projecting portion of said second rotatable member is not more than 40 microns.

43. An apparatus according to claim 39, wherein the amount of projection of said projecting portion of said second rotatable member is not more than 25 microns.

44. An apparatus according to claim 39, wherein the amount of projection of said projecting portion of said second rotatable member is not more than 20 microns.

45. An elastic rotatable member for conveying a material to be conveyed, comprising:

an elastic layer; and a resin surface layer formed on said elastic layer, said resin layer having an outwardly projecting portion which extends continuously along substantially the entire length of said rotatable member;

wherein said rotatable member has different diameters at its longitudinal end portions and at its center portion.

46. A member according to claim 45, wherein said projecting portion extends continuously in a direction substantially parallel to the rotational axis of said rotatable member.

47. A member according to claim 46, wherein the amount of projection of said projecting portion is different at the longitudinal end portions of said rotatable member than at its center portion.

48. A member according to claim 47, wherein said rotatable member is reversely crowned so that the diameter in the middle is smaller than that at the ends, and wherein the amount of projection of said projecting portion is larger in the middle than at the ends.

49. A member according to claim 45, wherein said elastic rotatable member is for fixing an image.

50. A member according to claim 49, wherein said elastic rotatable member includes a heating source therein to fix the image by heat.

51. A member according to claim 49, wherein the amount of projection of said projecting portion is not more than 40 microns.

52. A member according to claim 51, wherein the amount of projection of said projecting portion is not more than 25 microns.

53. A member according to claim 52, wherein the amount of projection of said projecting portion is not more than 20 microns.

54. A member according to claim 49, wherein a plurality of such projecting portions are formed, and the number thereof is not more than three.

55. A member according to claim 49, wherein only one such projecting portion is formed.

56. A member according to claim 1, 13, 21, 29 or 45 wherein the amount of projection of said projecting portion is not less than 2 microns.

57. An apparatus according to claim 6, 19 or 37, wherein the amount of projection of said projecting portion is not less than 2 microns.

* * * * *

UNITED STATES PATENT AND TRADEMARK OFFICE

CERTIFICATE OF CORRECTION

PATENT NO. : 4,910,559

DATED : March 20, 1990

INVENTOR(S) : TSUKASA KUGE, ET AL.

It is certified that error appears in the above-identified patent and that said Letters Patent is hereby corrected as shown below:

SHEET 3 OF 3

Figure 9:
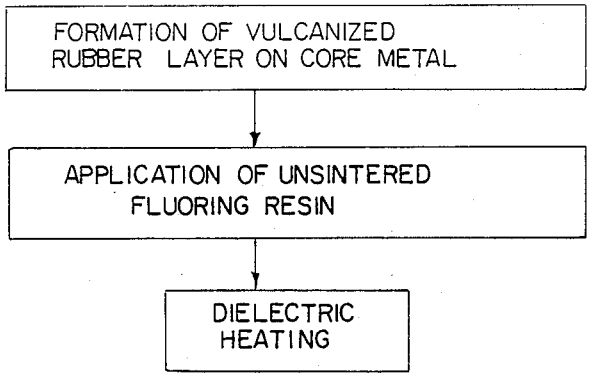
FIG. 9 is a flow chart illustrating the process of making an elastic rotatable member according to the present invention.

FIG. 9, "FLUORING" should read --FLUORINE--.

COLUMN 1

Line 5, "appliction" should read --application--.

COLUMN 5

Line 63, "method" should read --methods--.

COLUMN 6

Line 57, "method," should read --methods,--.

COLUMN 9

Line 61, "claim 29," should read --claim 19,--.

COLUMN 10

Line 3, Claim 25 should be deleted.
Line 23, Claim 30 should be deleted.
Line 26, Claim 31 should be deleted.

COLUMN 11

Line 1, Claim 41 should be deleted.

PRINTER'S TRIM LINE

UNITED STATES PATENT AND TRADEMARK OFFICE

CERTIFICATE OF CORRECTION

PATENT NO. : 4,910,559

DATED : March 20, 1990

INVENTOR(S) : TSUKASA KUGE, ET AL.

It is certified that error appears in the above-identified patent and that said Letters Patent is hereby corrected as shown below:

COLUMN 12

Line 25, "claim 1, 13, 21, 29 or 45" should read --claim 1, 13, 29 or 45--.

Signed and Sealed this

Fifteenth Day of September, 1992

*Attest:*

DOUGLAS B. COMER

*Attesting Officer*

*Acting Commissioner of Patents and Trademarks*